United States Patent [19]

Tomita et al.

[11] 4,034,453

[45] July 12, 1977

[54] METHOD OF MANUFACTURING LOUVER FINS FOR USE IN HEAT EXCHANGER

[75] Inventors: Syuuji Tomita; Yosihiro Miura; Akito Kubota, all of Tochigi, Japan

[73] Assignee: Hitachi, Ltd., Japan

[21] Appl. No.: 715,151

[22] Filed: Aug. 17, 1976

[30] Foreign Application Priority Data

Aug. 29, 1975 Japan ..... 50-103975

[51] Int. Cl.[2] ..... B23P 15/26

[52] U.S. Cl. ..... 29/157.3 C

[58] Field of Search ..... 29/159.3 C, 157.3 AH, 29/157.3 B, 157.3 A, 157.3 R

[56] References Cited

U.S. PATENT DOCUMENTS

| | | | |
|---|---|---|---|
| 2,994,123 | 8/1961 | Kritzer | 29/157.3 B |
| 3,741,460 | 6/1973 | Matulewicz | 29/157.3 C |

FOREIGN PATENT DOCUMENTS

| | | | |
|---|---|---|---|
| 1,393,736 | 5/1975 | United Kingdom | 29/157.3 C |
| 784,736 | 10/1957 | United Kingdom | 29/157.3 C |

*Primary Examiner*—C.W. Lanham
*Assistant Examiner*—V. Rising
*Attorney, Agent, or Firm*—Craig & Antonelli

[57] ABSTRACT

A method for producing louver fins for use in a heat exchanger, comprising the steps of forming in a sheet of thin fin blank a plurality of cylindrical collars in each of which a heat conductive tube is inserted, forming a plurality of bridge-shaped protruded louvers in parallel with the rows of cylindrical collars, inserting pilot pin in one of the cylindrical collars for predetermining a transverse width of the louver fin by measuring from the cylindrical collar, and cutting the blank sheet into the predetermined transverse width for obtaining a multiplicity of fin louvers with the predetermined width from the blank sheet.

1 Claim, 12 Drawing Figures

METHOD OF MANUFACTURING LOUVER FINS FOR USE IN HEAT EXCHANGER

This invention relates to a method of manufacturing louver fins of a cross-fin tube type heat exchanger with louvers for use in an air conditioner and the like, wherein a multiplicity of fins with louvers are parallely provided and a plurality of heat conductive pipes are closely fitted into said parallely provided fins.

A cross-fin tube type heat exchanger is of such an arrangement that: a multiplicity of fins formed of an aluminum plate, etc. of a given area are parallely provided at a pitch of several mm; a plurality of heat conductive pipes made of copper and the like are inserted into said parallely provided fins; said heat conductive pipes are flared so as to closely fit the fins; and end portions of the heat conductive pipes disposed outside of the fins are connected to each other by means of letter U-shaped connecting tubes, thereby forming a suitable number of meandering passageways of heat conductive pipes.

Said cross-fin tube type heat exchanger is a heat exchanger for use in an air conditioner and the like, wherein a heat transfer medium such as a refrigeration medium is circulated through the heat conductive pipes, while at the outside air is circulated between the parallely provided fins, thereby effecting heat exchange between the heat transfer medium within the pipes and air circulating outside of the pipes through the pipe walls and the fins.

Said heat exchange action is carried out such that heat of the heat transfer medium within the heat conductive pipes is transmitted to the heat conductive pipes, further conducted to a multiplicity of fins closely fitting said pipes, and heat exchange is effected between said heat conductive pipes and air contacting and passing through the surfaces of fins.

The heat transfer performance of the heat exchanger of the type described is influenced to a considerable extent by heat transmission between the surfaces of fins and the circulating air. A boundary layer of stream is formed in the air stream flowing between the flat fins, said boundary layer is developed into a thick one as proceeding from the forward end portion of fin to the downstream side thereof, and the boundary layers generated at the surfaces of fins disposed in opposite relation to each other meet at a position slightly downstream of the forward end of the fin. Heat transmission within said boundary layer is decreased in effectiveness to a considerable extent as compared with heat transmission in the turburent stream zone.

In order to prevent the generation of said boundary layer and improve heat transmission, there has been proposed a cross-fin tube type heat exchanger with louvers having plate fins provided therein with a plurality of louvers formed by shaving. In said heat exchanger, the streamlines of air flowing between the fins are cut by use of louvers formed by shaving, thereby preventing the generation of the laminarly flowing boundary layer and at the same time improving heat transfer rate.

The present invention, as well as its advantages, may be understood by reference to the following detailed description and drawings in which.

Figure 1:
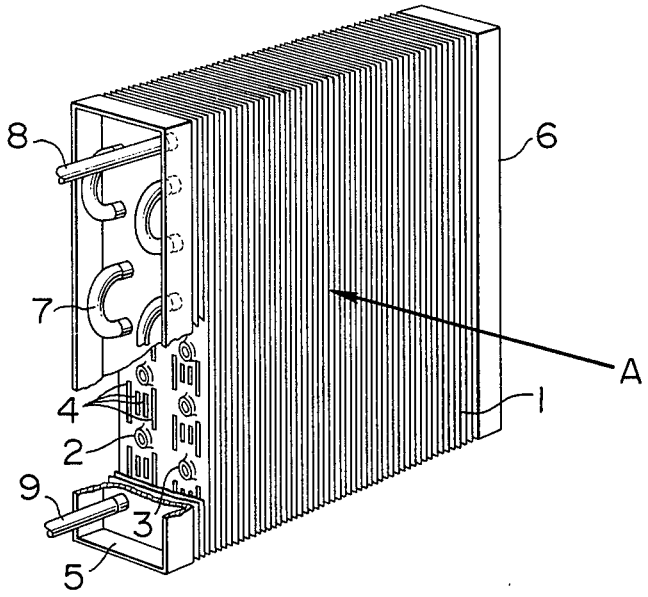
FIG. 1 is an oblique view, partly broken, showing the cross-fin tube type heat exchanger.
Figure 2:
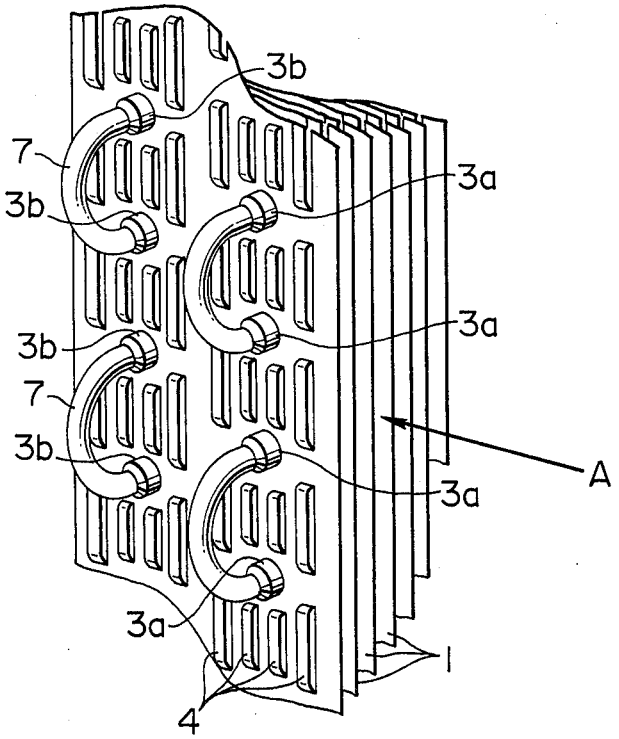
FIG. 2 is an enlarged partial view of FIG. 1 with side plates removed therefrom.

In FIG. 1 and FIG. 2, designated at reference numeral 1 is a fin made of a thin aluminum plate cut into a given area. Said fin is provided therein with cylindrical collars 3 for receiving heat conductive pipes 2 and with a plurality of louvers 4 formed by shaving. A plurality of rows 3*a*, 3*b* (FIG. 2 shows two rows.) of cylindrical collars are arranged in zigzag manner to air circulating between the fins in the direction indicated by an arrow A. The louvers 4 formed by shaving are provided perpendicularly to the airflow direction indicated by the arrow A between the respective cylindrical collars 3, i.e., lengthwise in parallel with the rows of cylindrical collars, The heat exchanger is constructed such that: a multiplicity of louvers formed by shaving are parallely provided; a plurality of heat conductive pipes 2 are inserted into the cylindrical collars 3; thereafter, said heat conductive pipes are flared so as to closely fit the collar portions; side plates 5, 6 are provided at the opposite sides thereof; further, end portions of the respective heat conductive pipes are connected to each other by means of letter U-shaped connecting tubes 7, thereby forming one or a plurality of meandering passageway of heat conductive pipes; and inlet pipes 8 and outlet pipes 9 are connected to the end portions of the passageways of heat conductive pipes.

In the cross-fin tube type heat exchanger with the louvers formed by shaving constructed as above, a heat transfer medium such as a refrigeration medium is caused to flow through the heat conductive pipes 2 from the inlet pipe 8, heat of said heat transfer medium is transmitted to the heat conductive pipes 2, further, conducted to the fins 1 generally through the cylindrical collars 3, and the heat transfer medium flows out of the outlet pipes 9.

On the other hand, air is blown in the direction indicated by the arrow A by means of an air blower, flows between the respective fins, circulates and contacts the surfaces of the respective fins 1 and the heat conductive pipes 2. Heat is conducted to said circulating air from said heat conductive pipes 2 and fins 1, thereby effecting heat exchange action.

Since the fins 1 are provided therein with the plurality of louvers 4 formed by shaving intersecting perpendicular to the direction of circulating air, the streamlines of air flowing in the direction indicated by the arrow A impinge repeatedly on the louvers 4 formed by shaving and are cut therewith. Hence, the laminarly flowing boundary layer generated within the air flowing between the fins is cut and prevented from being developed, and many portions having little boundary layer and high heat transfer rate are formed.

Heretofore, the method of manufacturing the fins with louvers for use in the cross-fin tube type heat exchanger with louvers has comprised a process of bulging, a process of piercing and burring, a process of curling, a process of louver notching, a process of louver forming, a process of multiple-row cutting, and a process of longitudinal cutting.

Figure 3:
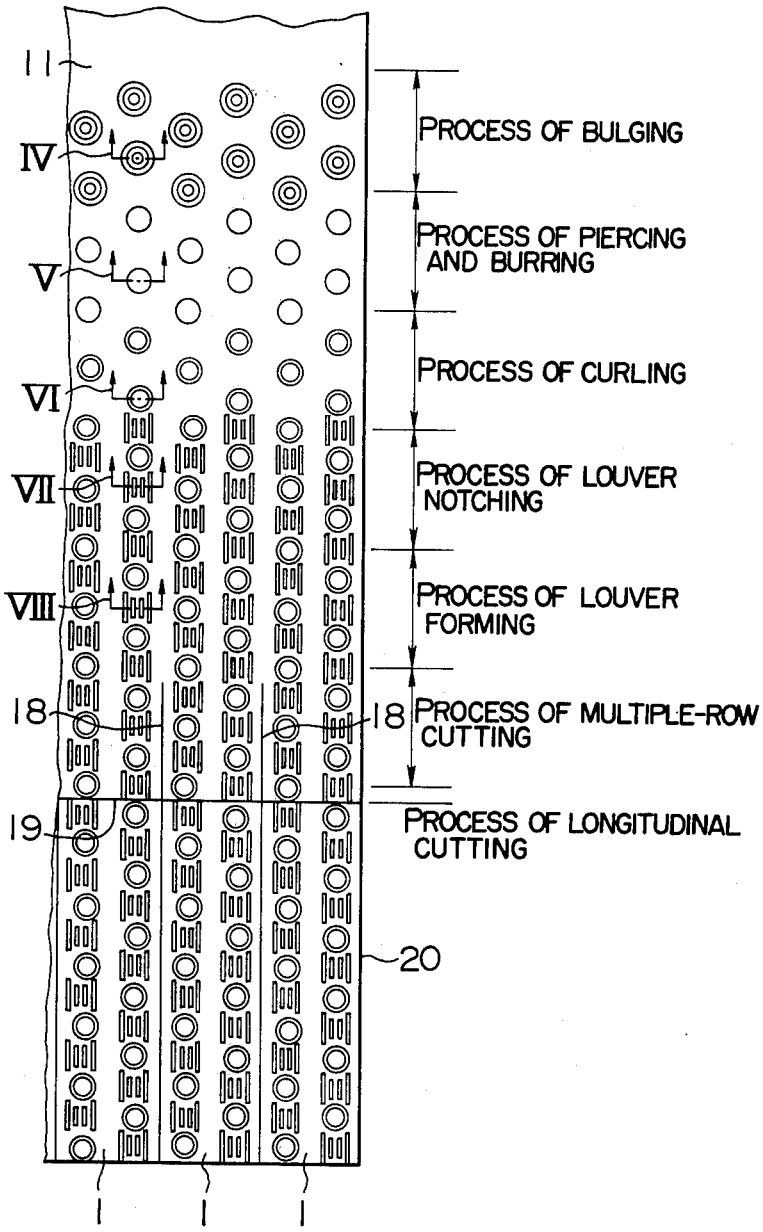
FIG. 3 is a plan view showing the configuration of the fin blank of louver fin manufactured by the conventional manufacturing processes.
Figure 9:
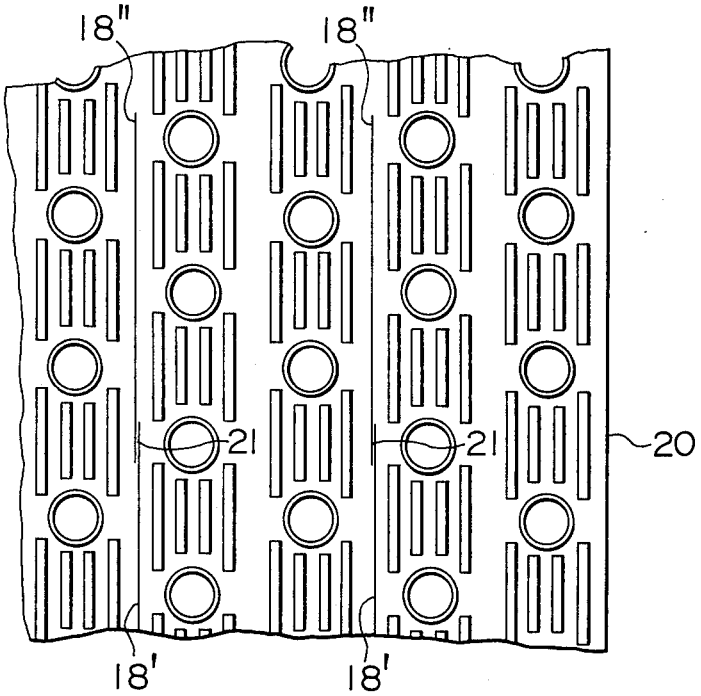
FIG. 9 is an enlarged view of the fin blank of the portion of the process of multiple-row cutting.
Figure 10:
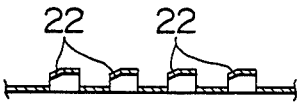
FIG. 10 is a view showing the changes in shape at the time of the process of forming bridges.

FIG. 3 shows the configuration of the fin blank manufactured by the manufacturing processes described above; FIG. 4 through FIG. 8 are cross-sectional views of the blank taken along lines of IV—IV, V—V, VI—VI, VII—VII and VIII—VIII in FIG. 3; FIG. 9 is an enlarged view of the fin blank of the portion of the process of row cutting; and FIG. 10 is a view showing changes in shape at the time of the process of forming bridges.

Figure 4:
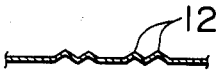
FIG. 4 through FIG. 8 are enlarged cross-sectional views taken along lines of IV—IV, V—V, VI—VI, VII—VII and VIII—VIII in FIG. 3.

In FIG. 3, designated at 11 is a fin blank made of a thin aluminum plate and having a breadth sufficient to cover a plurality of individual fins. Refering to drawings, said fin blank is moved from process to process downwardly stating from the top. First, the fin blank 11 is forwarded to the process of bulging. As described above, the holes provided in the fins for receiving the heat conductive pipes are formed of cylindrical collars. This is the process where stretch is previously rendered to the fin blank for striking out the cylindrical collars through said hole portions, and a plurality of wavy circles 12 are formed around the positions of said hole portions as shown in FIG. 4.

Figure 5:
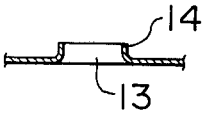

Next, the fin blank is forwarded to the process of piercing and burring where the holes 13 for receiving the heat conductive pipes are formed as shown in FIG. 5, and at the same time the cylindrical collars 14 for fitting the heat conductive pipes are pressed into shapes.

Figure 6:
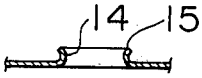

Thereafter, the fin blank is forwarded to the process of curling where the forward ends of the cylindrical collars 14 are curled outwardly as shown in FIG. 6 to form curling portions 15, and the height of cylindrical collar 14 is controlled to a given length in order to maintain the fin pitch 8 at the time of assembling the heat exchanger.

Figure 7:
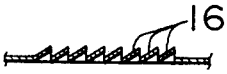

Next, the fin blank is forwarded to the process of louver notching where, as shown in FIG. 7, a plurality of notches are provided in the longitudinal direction of louver by means of an upper oblique blade and a lower oblique blade (not shown) to form a shutter-shaped louver 16.

Figure 8:
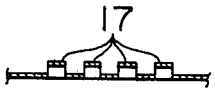

Thereafter, the fin blank is forwarded to the process of louver forming where, as shown in FIG. 8, said shutter-shaped louver 16 is arranged to be a bridge-shaped louver 17 by means of an upper and a lower dies (not shown).

Next, the fin blank is forwarded to the process of multiple-row cutting where, as shown in FIG. 3, notches 18 are provided in the longitudinal direction for cutting into fins of given breadth.

Thereafter, the fin blank is forwarded to the process of longitudinal cutting where crosswise notches 19 are provided in the fin blank at the positions of a given length for dividing the fin blank into the individual fins, thereby enabling to obtain the individual fins each having louvers and a given area.

The fin blank is moved from process to process in the order described above. However, the manufacturing work is being carried out continuously and hence all the processes are being performed practically simultaneously.

The aluminum plate forming the fin blank is small in thickness, the manufacture includes many processes, particularly in the process of louver notching, the fin blank is shaped into s shutter shape by means of the upper and lower oblique blades. Hence, at the time of notching a force acts on the fin blank in the direction of breadth whereby crosswise stretch is generated in the fin blank and variations are found in the value of said stretch. Consequently, if the processes of louver forming and of multiple-row cutting are carried out as referenced from the position of the side edge 20 of the fin blank, then, as shown in FIG. 9, with regard to the notch 18 of row cutting, the notch 18′ of the preceding process and the notch 18″ of the process at present are shifted out of position from each other, thereby producing a fiber-like shorn-off piece 21. Additionally, as shown in FIG. 10, a change 22 in shape occurs during the process of louver forming.

The present invention has been invented in view of the above, and contemplates to eliminate the production of the fiber-like shorn-off piece during the process of multiple-row cutting and the occurence of change in shape during the process of louver forming, without being influenced by said value of stretch in the direction of breadth of the fin.

In order to attain the aforesaid purpose, the present invention has such an arrangement that a process of inserting pilot pins into the cylindrical collars of fins and of positioning the fins in the direction of breadth as referenced from said cylindrical collars is provided between the process of louver forming and the process of multiple-row cutting, so that the process of multiple-row cutting and the process of louver forming can be carried out with the fin being maintained in the accurate position.

Figure 11:
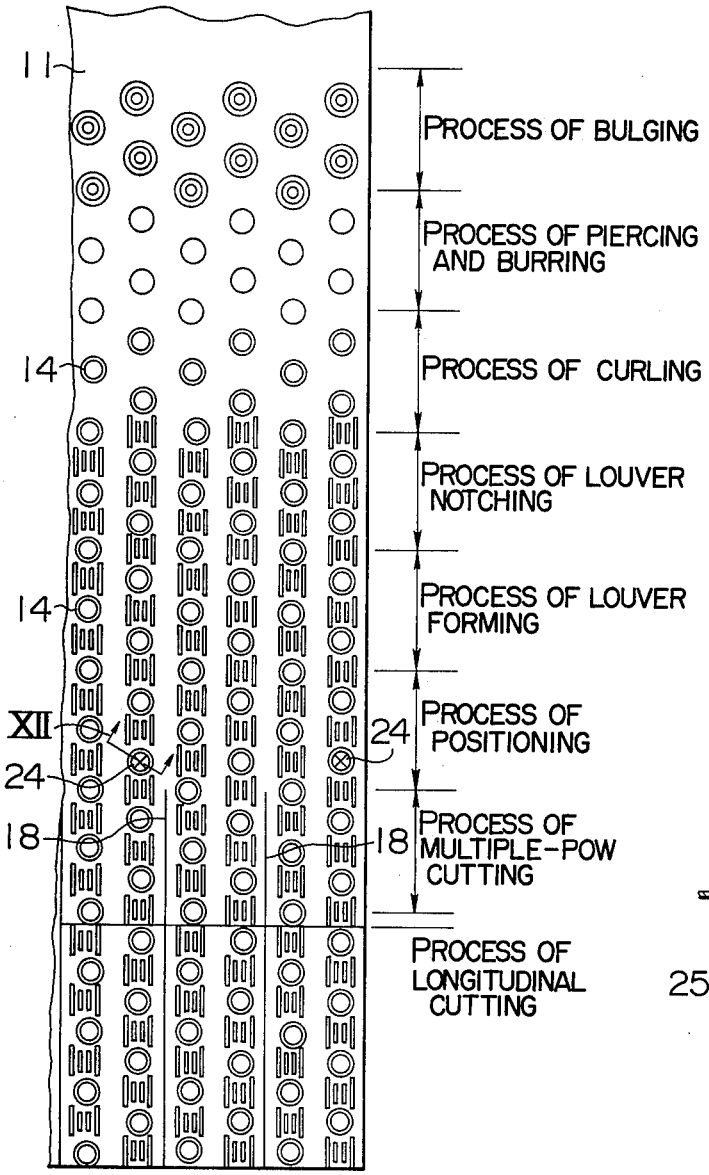
FIG. 11 is a plan view showing the changes in configuration of fin blank from process to process, which is one embodiment of the present invention.
Figure 12:
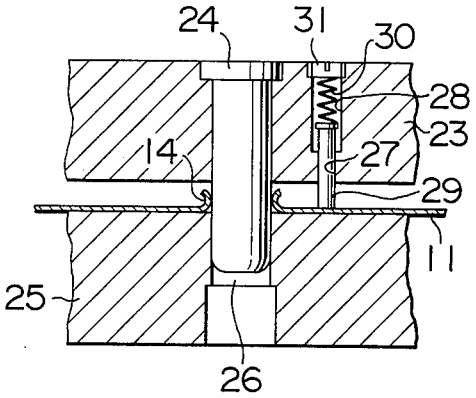
FIG. 12 is a cross-sectional view taken along line XII—XII in FIG. 12.

Description will given of one embodiment of the present invention with reference to FIG. 11 and FIG. 12. FIG. 11 shows the changes in the configuration of fin blank from process to process, which is manufactured with the process according to the present invention being inserted; and FIG. 12 is a view in explanation of the cross-section at the position of XII—XII in FIG. 11.

The fin blank 11 is successively forwarded to the process of bulging, the process of piercing and burring, the process of curling, the process of louver notching, and the process of louver forming. As far as the above-mentioned processes are concerned, everything is same as in the prior art and the same manufacturing works are carried out.

Next, the process of positioning according to the present invention is inserted, and thereafter, the process of multiple-row cutting and the process of longitudinal cutting are carried out in the same manner as in the prior art.

Said process of positioning is the process where the position of fin is accurately maintained as referenced from the positions of the holes of the cylindrical collars 14 which have been formed during the process of piercing and burring and the process of curling, and, as shown in FIG. 12, the upper die 23 for presswork is provided therein with a pilot pin 24 having a semi-spherical lower end, and the lower die 25 is provided therein with a pilot hole 26 disposed in opposite relationship with said pin 24. A plurality of pilot pins 24 are provided in the direction of breadth of fin blank 11 (In this embodiment, the pins are provided at the opposite sides and the center.). Additionally, the upper die 23 for presswork is contiguously provided in the vicinity of the pilot pin 24 thereof with a pin hole 27 disposed at the bottom and a spring hole 28 of a diamter slightly larger than that of said pin hole and disposed upwardly of said pin hole. A snap-in pin 29 is vertically, slidably inserted into said pin hole 27, a coil spring 30 is secured to the upper end of the snap-in pin 29, the other end of said coil spring 30 is secured to the spring seat 31 fixed at the upper portion of the spring hole 28, so that the snap-in pin 29 is normally urged downwardly by the resilient force of the spring 30.

After the process of louver forming, the fin blank 11 is forwarded to this process of positioning where the cylindrical collars 14 of the fin blank 11 are positioned practically at the same position as the pilot hole 26 of the lower die 25, thereafter, said upper die 23 for presswork is lowered, thereby causing the pilot pin 24 to be inserted into the cylindrical collar 14 and the pilot hole 26 of the lower die 25. In this case, the snap-in pin 29 is caused by the resilient force of the spring 30 to push the fin blank 11 to closely fit the lower die, whereby the influence of warpage is eliminated, thereby improving accuracy in position.

The fin blank 11 is caused by the inserting work of said pilot pin 24 to make a very little movement, so that even a slight error in position can be corrected, thereby enabling to maintain the fin blank 11 in the accurate position (The drawing shows the pilot pin at the time of insertion.).

Consequently, during the manufacturing work of the processes of louver forming and of the multiple-row cutting, the fin blank 11 is maintained in the accurate position as referenced from the cylindrical collars 14. Hence, the occurrence of a change in the direction of breadth can be eliminated in the process of louver forming, so that a lover 4 can be accurately formed into a bridge shape. Additionally, the position of notch 18 of multiple-row cutting is constantly cut in at a given position as referenced from the cylindrical collar 14 and hence the production of fiber-like shorn-off piece 21 (Refer to FIG. 9.) is eliminated.

In the case that the pilot pin 24 is removed from the cylindrical collar 14 by lifting the upper die 23 for presswork in order to transfer the fin blank 11 to the succeeding process of row cutting, said snap-in pin 29 is urging the fin blank 11 against the lower die 25 in such a manner that the fin blank 11 is not lifted together with the pilot pin 24 and said pilot pin 24 can be readily removed from the cylindrical collar 14. When the upper die 23 for presswork is lifted and the pilot pin 24 is separated from the upper end of the cylindricall collar 14, the snap-in pin 29 is separated from the fin blank 11 as well.

As has been described above, according to the present invention the process of positioning is provided between the process of louver forming and the process of multiple-row cutting and hence the fin blank is accurately maintained in position (particularly, position in the direction of breadth), the positions for bridge-like forming of louvers and for multiple-row cutting are determined as referenced from the position of the cylindrical collar. Consequently, the louvers are accurately formed into bridge shapes, no change in the direction of breadth occurs, and the notches of row cutting are constantly cut in at a given position, thereby eliminating the production of fiber-like shorn-off piece.

Additionally, the embodiment of the present invention include the following embodiments in addition to the one described in the scope of claim.

1. A method of manufacturing louver fins for heat exchange characterized by providing a process of inserting pilot pins into the cylindrical collars, having snap-in means to correct warpage of fin blank and positioning the fin in the direction of breadth as referenced from the cylindrical collar between the process of forming a multiplicity of cylindrical collars for receiving the heat conductive pipes in the thin sheet-shaped fin blank of a suitable area and thereafter forming a plurality of bridge-shaped louvers by shaving in parallel with the row of the cylindrical collars and the multiple-row cutting process of cutting said fin blank into fins of a given breadth.

2. An apparatus for manufacturing louver fins for heat exchange, wherein a process carried out by a positioning means comprising an upper die for presswork provided at the under surface thereof with a pilot pin and a lower die provided therein with a pilot hole in opposite retationship with said pilot pin is inserted between the process of forming a multiplicity of cylindrical collars for receiving the heat conductive pipes in the thin sheet-shaped fin blank of a suitable area and thereafter forming a plurality of bridge-shaped louvers by shaving in parallel with the row of the cylindrical collars and the multiple-row cutting process of cutting said fin blank into fins of a given breadth.

3. An apparatus for manufacturing louver fins for heat exchange as set forth in item 2, comprising snap-in means provided in the vicinity of the pilot pin with a snap-in pin which is vertically, slidably inserted into the upper die for presswork and normally pushed out of the under surface of said upper die for presswork by the resilient force of a spring.

We claim:

1. In a method for producing louver fins for use in a heat exchanger, comprising the steps of forming in a sheet of thin fin blank a plurality of cylindrical collar portions in each of which a heat conductive tube is inserted, forming a plurality of bridge-shaped protruded louvers in parallel with the rows of cylindrical collar portions, and cutting the blank into a multiplicity of rows with a predetermined width, the improvement comprising the step of inserting a pilot pin in one of the cylindrical collars between the step of forming the louvers and the step of cutting the blank, whereby a transverse width of the louver fin to be cut is predetermined correctly.

* * * * *